US007025665B2

(12) United States Patent
Bender

(10) Patent No.: US 7,025,665 B2
(45) Date of Patent: Apr. 11, 2006

(54) METHOD AND APPARATUS FOR CUTTING ULTRA THIN SILICON WAFERS

(75) Inventor: David L. Bender, Thousand Oaks, CA (US)

(73) Assignee: Solaicx, Inc., Santa Clara, CA (US)

( * ) Notice: Subject to any disclaimer, the term of this patent is extended or adjusted under 35 U.S.C. 154(b) by 0 days.

(21) Appl. No.: 11/089,725

(22) Filed: Mar. 24, 2005

(65) Prior Publication Data

US 2005/0217656 A1 Oct. 6, 2005

Related U.S. Application Data

(60) Provisional application No. 60/557,495, filed on Mar. 30, 2004.

(51) Int. Cl.
*B24B 21/00* (2006.01)
*B28D 1/08* (2006.01)

(52) U.S. Cl. ..... 451/296; 125/16.02; 125/21; 451/304

(58) Field of Classification Search ..... 451/36, 451/296, 304; 125/21, 16.01, 16.02
See application file for complete search history.

(56) References Cited

U.S. PATENT DOCUMENTS 3,831,576 A * 8/1974 Mech ..... 125/12
5,715,806 A * 2/1998 Tonegawa et al. ..... 125/16.02
6,095,129 A * 8/2000 Kanemichi et al. ..... 125/16.02
6,119,673 A * 9/2000 Nakaura ..... 125/12
6,182,729 B1 * 2/2001 Banzawa et al. ..... 156/353
6,283,111 B1 * 9/2001 Onizaki et al. ..... 125/16.01
6,352,071 B1 * 3/2002 Kononchuk et al. ..... 125/16.02
6,352,072 B1 * 3/2002 Honma et al. ..... 125/21
6,367,467 B1 * 4/2002 McGregor et al. ..... 125/35
6,889,684 B1 * 5/2005 McAulay et al. ..... 125/21

FOREIGN PATENT DOCUMENTS

JP 404169205 * 6/1992

* cited by examiner

*Primary Examiner*—Eileen P. Morgan
(74) *Attorney, Agent, or Firm*—Woodside IP Group; Michael Hetherington

(57) ABSTRACT

A wire saw and wafer stabilizing system are provided for holding wafer sections invariantly against vibration and unwanted movement during the sawing process. A stabilizing means is applied to the ends of partially defined wafer sections at an early stage when the wafer sections are partially cut through a silicon ingot or block of silicon material. The stabilizing means serves to stabilize the wafer sections immovably against vibration, oscillation, or unwanted contact during the subsequent sawing process. The stabilizing system also accelerates handling of the wafers after slicing is completed, facilitates the cleaning process, and allows for more rapid or automated placement of the wafers in cassettes. Wafers produced by the stabilizing system are characterized by a minimized total thickness variation, substantially uniform planarity, and substantially without bow or warp.

15 Claims, 5 Drawing Sheets

METHOD AND APPARATUS FOR CUTTING ULTRA THIN SILICON WAFERS

CROSS-REFERENCE TO RELATED APPLICATION

This patent application claims the benefit of U.S. provisional patent application Ser. No. 60/557,495, filed Mar. 30, 2004.

BACKGROUND

1. Field of the Invention

The field of the invention generally relates to a method and apparatus for cutting silicon ingots to produce silicon wafers. In particular, the field of the invention relates to an improved wire saw comprising the placement of a stabilizing strip for holding adjacent wafers in the sawing process to stabilize the wafers against vibratory effects and facilitate automated processing of the finished wafers. The stabilizing strip enables cutting of ultra thin silicon wafers with a conventional process, resulting in low kerf loss, improved material utilization, minimized total thickness variation, and thus greater cost effectiveness.

2. Background of Related Art

Conventional wire saws or wire-webs for slicing silicon are well known. Such wire saws typically comprise a row of fine, high tensile strength wires having diameters on the order of 0.1–0.2 millimeters. The wires are disposed in parallel with one another and are translated in the same direction. A workpiece is pressed against these wires. At the same time, an abrasive suspension fluid is supplied between the work piece and the wires, enabling the wires to slice the workpiece into wafers by an abrasive grinding action. The liquid suspended abrasive particles are provided onto the moving "web" or wire through a circulation system that places a blanket like coating of the abrasive suspensions onto the "web" just before the wire-web impacts the work piece. The abrasive particles carried by the liquid are transferred via the coated wires to produce a grinding or cutting effect.

More recently, diamond coated wires are employed in wire saws in an attempt to increase the rate of cutting of silicon wafers. The workpiece is pressed against the diamond wire and the cutting process is augmented by diamond particles embedded in the wire. However, due to their smaller core diameter, diamond saw wires are more fragile. Such mechanical sensitivity promotes damage and cracks in the wires at tensioning and guide rollers.

In a conventional wire sawing process, the wire is high tensile strength brass plated steel wire, and the actual cutting is done in a slurry consisting of oil or polyethylene glycol and silicon carbide. Since this is a free abrasive process, undesirably high wire speeds are required. Also, large quantities of slurry are required for slicing and cooling. Because of this, strong hydraulic forces are applied to the wafers being cut creating problems when slicing thin wafers. Since a great amount of process stress is applied to the wafers, there is a further problem in that residual process distortion becomes great.

U.S. Pat. No. 5,937,844 describes how a conventional wire saw process using a slurry results in a variation of the rate of transport of abrasive grains as the wire web cuts down through the ingot. Accordingly, there is a need to adjust the rate of feed of slurry or vary viscosity.

U.S. Pat. No. 5,099,820 discloses an abrasive liquid as a suspension of particles of silicon carbide in water or oil.

However, such conventional suspensions are not stable and do not provide uniform coating on the cutting wires. Furthermore, such compositions require vigorous agitation to maintain uniform suspension of the particles, and the suspension settles out quickly under stagnant conditions, and even during workpiece slicing while still under agitation.

Achieving an optimum cutting quality depends on a combination of parameters, the quality (lubricity, viscosity, tack properties, etc.) of the abrasive fluid and the force with which the workpiece is pressed against the set of free abrasive or diamond coated wires. In a conventional wire saw, silicon wafers consisting of brittle material are cut with wire characterized by high tensile strength and hardness. When cutting is done using conventional adhering free abrasive particles, or diamond wire, an extreme amount of process stress is applied to the wafers. The force of the wires against the workpiece can deform the workpiece and degrade planarity characteristics in the resulting wafer, thus adding to the need for further processing time and adding to overall cost.

It also has been found that a conventional free abrasive wire or diamond-coated wire sawing process tends to cause the wafers to oscillate and to deform during the sawing process. When slicing very thin wafers, one of the problems encountered is that as the wires progress downward through the ingot, unsupported sections of the wafers tend to vibrate, move, or stick together. This disadvantageously imposes a limit on the thickness of wafers that can be achieved through a current mass production wire saw process. Vibration and oscillation of the wafers also contribute to surface damage of the wafer such as wire marks that are difficult to remove and adversely affect wafer performance. Vibration and oscillation of the wafers also contribute to stress applied to the wire and limit diameter reduction of the steel strength member, limiting kerf reduction and providing sub-optimal material utilization.

Mass production considerations, such as the rate of wear of the wire, the effectiveness, recovery and recycling of the cutting and lubricating fluids, are important factors in achieving high cutting quality at a reasonable cost. Cutting quality typically refers to the ability to provide exact planarity of surfaces without taper, bow, warp, thickness variation and surface damage to yield products suitable as a starting base for advanced semiconductor devices and solar cells.

For many applications, ultra thin wafers of substantially uniform thickness, low warp and low bow are desired. For high efficiency, long life solar cells, precise planar dimensions are critical in the formation of a starting wafer to provide a predictable, stable base for the subsequent processes such as diffusion, anti-reflective coatings and thermal processes. Conventional wire saws have disadvantages in attempting to provide a cost effective way to cut silicon into very thin wafers, with thicknesses down to 200 microns or less, that would be suitable for use in solar cells. Imperfections due to process distortion or defects in planarity, warp, bow, variations in thickness and surface damage are still too prevalent to achieve cost effective mass production of ultra thin silicon wafers suitable as a starting base for a high efficiency low cost solar cell.

Therefore, what is needed is a wire saw and cutting system that can optimize the cutting quality that can be obtained on silicon under mass production conditions. What is also needed is a wire saw system that can apply an optimum cutting pressure to the wafers and eliminate process distortion. Such a system advantageously would enable cutting of thinner, lightweight wafers with improved control and stabilization. Such a system ideally would minimize total thickness variation (TTV), provide substantially uniform planarity, and substantially eliminate bow and warp. Optimum cutting pressure to the wafers also reduces stress on the wire and enables use of thinner wires that reduces kerf losses and increases material utilization, contributing to lower cost. Such ultra thin, uniform silicon wafer, that can be mass-produced at reasonable cost would be especially useful as a starting material for a high efficiency solar cell.

There exists a need for a novel cutting and lubricating composition that would provide a uniform supply of homogeneously dispersed abrasive particles, attached to and traveling with the wire, without abrasive particle agglomeration or "hard-cake" formation from suspension fallout. Such a cutting/lubricating composition advantageously would enable a workpiece to be cut more efficiently, requiring less cutting pressure and minimizing distortion. Further, the cutting composition should have excellent lubricity and heat transfer properties to remove the frictional heat generated at the cutting site thereby increasing working life of the wire and avoiding process downtime. It is also desirable that the composition should provide a stable suspension of abrasive particles.

When the ultra thin wafers (having a thickness down to the order of 200 microns or less) are released from the wire saw, it is imperative to keep the wafers from adhering to one another to avoid damage when placing the wafers into cassettes for further processing operations. Thus, there is also a need for automated handling of the released wafers in a non-contacting arrangement for subsequent transport and insertion into cassettes for final processing. It especially would be desirable to provide a means for automated positioning of wafers into cassettes of varying dimensions to facilitate further processing operations.

SUMMARY

In order to overcome the foregoing limitations and disadvantages inherent in a conventional wire saw process for cutting silicon, an aspect of the invention provides a stabilizing strip system for holding the wafers invariantly against vibration during the sawing process. The stabilizing strip is applied to the ends of the partially defined wafers at an early stage in the sawing process when the wafers have been partially cut through a silicon ingot or block of silicon material. The stabilizing strip can be held in place by any convenient positioning means, such as adhesive material. The stabilizing strip serves to keep the silicon slices (the incipient wafers) separate, and prevents the slices from vibrating, oscillating, or touching during the slicing process.

The stabilizing strip system when combined with a conventional wire saw advantageously produces thinner, lightweight wafers with improved control and stabilization. Wafers produced by the stabilizing strip system are characterized by a minimized total thickness variation (TTV), substantially uniform planarity, and substantial elimination of bow and warp.

The stabilizing strip system also improves and accelerates handling of the wafers after the slicing is completed, further facilitates the cleaning process, and allows for more rapid or automated placement of the wafers in cassettes.

In accordance with another aspect of the invention, a wire saw system, comprising a stabilizing strip, uses a small diameter diamond coated or diamond impregnated wire and a very low viscosity fluid composition for cutting ultra thin silicon wafers. The diamond-coated or impregnated wire, being a fixed abrasive, can be operated at a much lower wire speed than in a conventional process. The lower wire speed in combination with the stabilizing strip for holding the wafers invariantly against vibration results in greatly reduced stress and lower hydraulic forces being imposed on the wafers. The stabilizing feature advantageously provides a dampening effect on vibration, thereby greatly reducing or substantially eliminating process stress within the wafers. This advantageously results in a structurally stronger wafer. Since lower wire speed reduces stress, this advantageously enables the use of smaller wires without breakage and further creates lower kerf loss and higher material utilization. This aspect of the invention further facilitates the slicing of ultra thin silicon wafers in a mass production process at reasonable cost.

The use of diamond impregnated wire also advantageously provides a fixed rate of abrasive particles thereby eliminating complex systems for varying the feed rate of slurry to compensate for variations in the rate of transport of abrasive grains, in contrast to a conventional wire saw system.

These and other features and aspects of the invention provide a process and apparatus for slicing very thin silicon wafers, down to dimensions on the order of 200 microns or less with superior physical properties, such as substantially uniform planarity, substantial elimination of bow or warp, low kerf loss, improved material utilization, and thus markedly lower cost than is currently possible using a conventional wire saw system.

BRIEF DESCRIPTION OF THE DRAWINGS

The drawings are heuristic for clarity. The foregoing and other features, aspects and advantages of the invention will become better understood with regard to the following description, appended claims and accompanying drawings in which:

DETAILED DESCRIPTION

Figure 1:
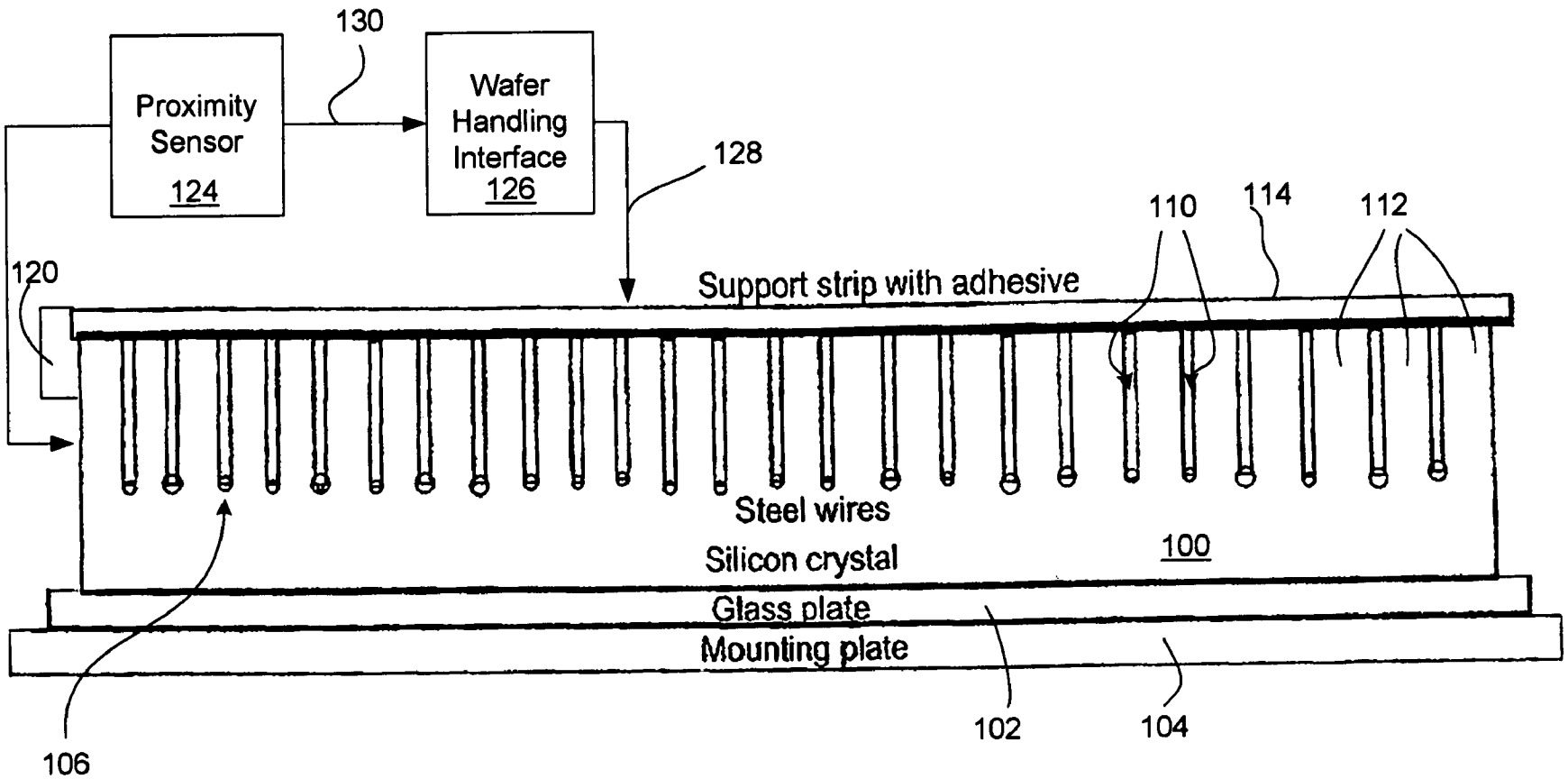
FIG. 1 is a side view of an apparatus for slicing a silicon crystal into a plurality of wafers, including a wafer support strip for stabilizing the wafers according to an aspect of the invention.
Figure 2:
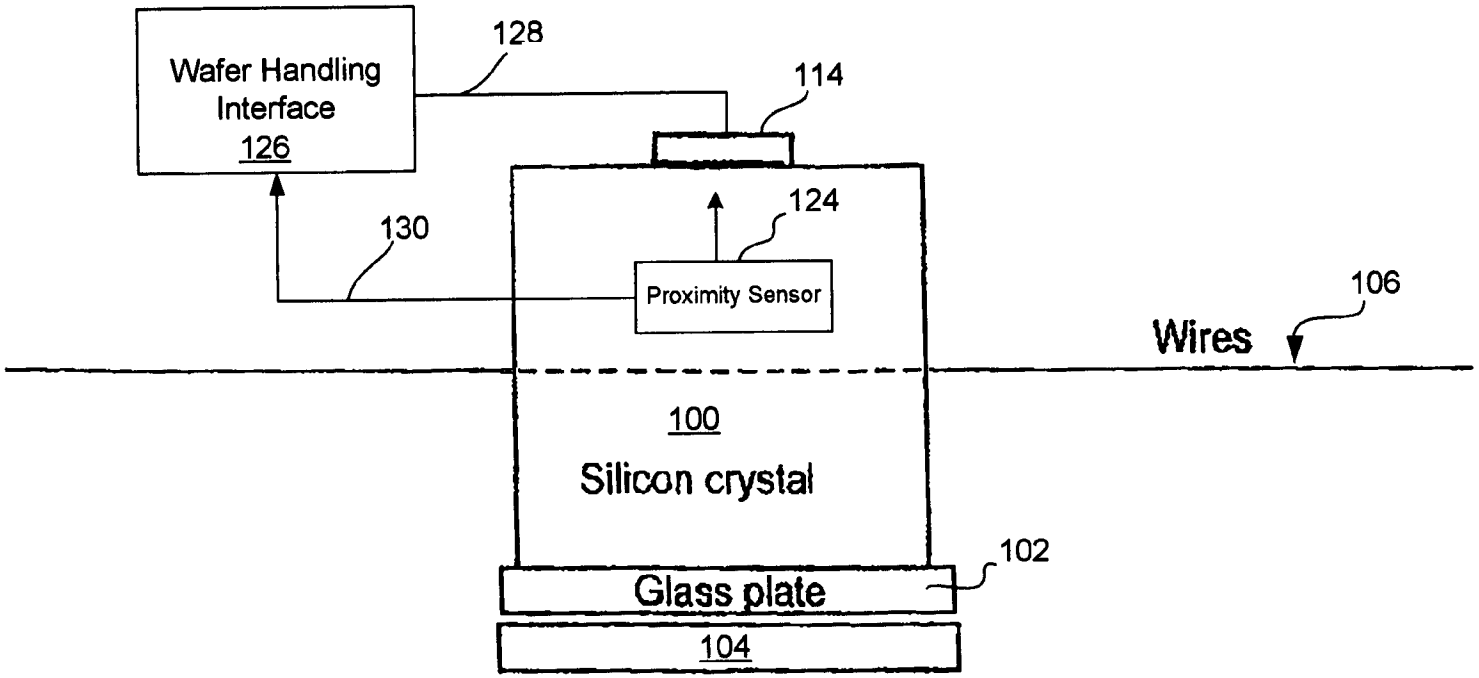
FIG. 2 is an end view of the apparatus shown in FIG. 1.
Figure 3:
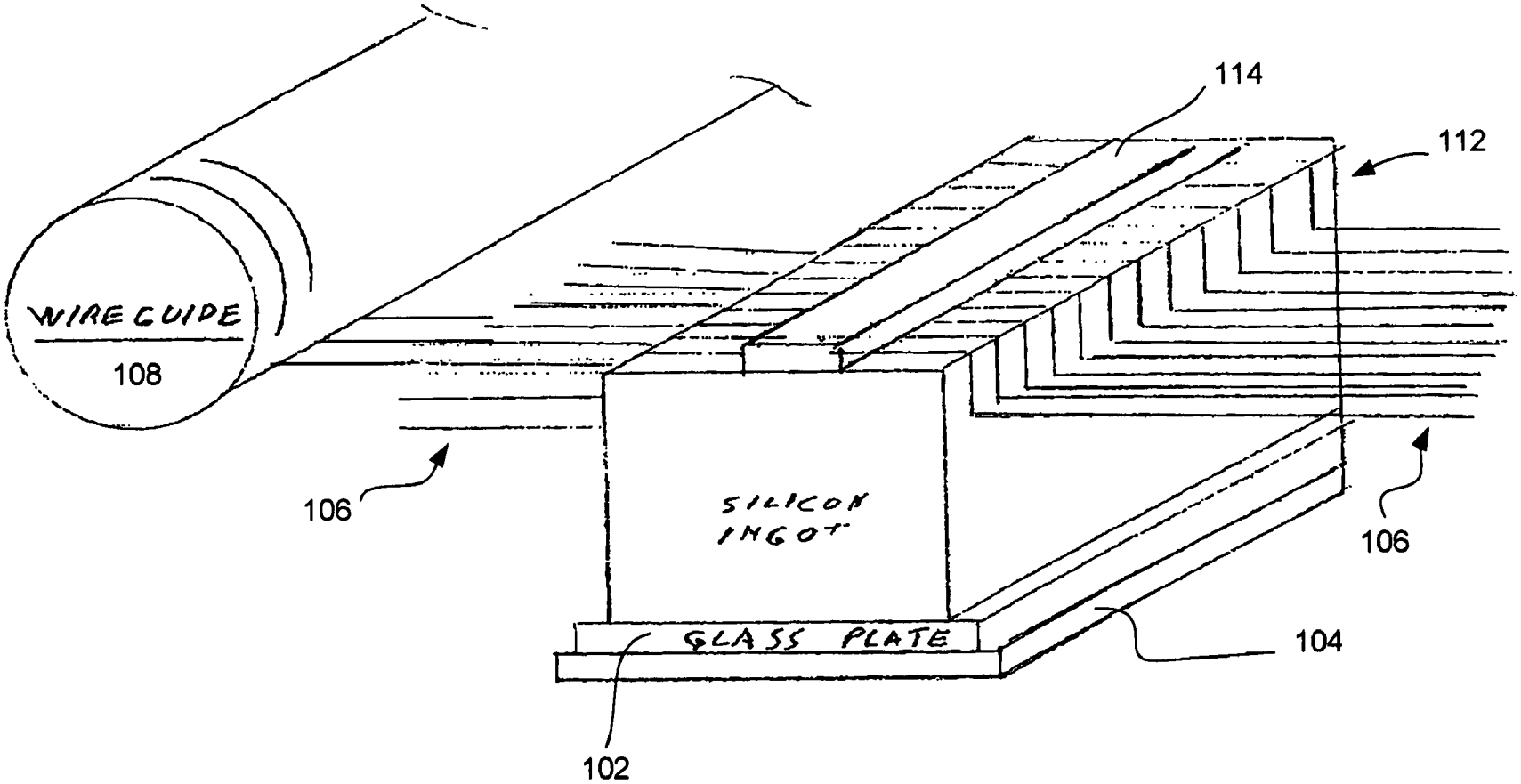
FIG. 3 is a perspective view of the apparatus of FIG. 1, including a wire guide.

Referring to FIGS. 1, 2 and 3, an ingot or block of silicon 100 is provided on a glass plate or cutting beam 102. The cutting beam 102 also can be graphite epoxy or similar material, which in turn is positioned on a conventional mounting plate 104 for holding the block of silicon during the wire sawing process. The mounting plate slides into a fixture in the wire saw (not shown for clarity). The wire 106 is looped over the wire guide 108 (FIG. 3) to form a wire web comprising the plurality of cutting surfaces, each wire 106 providing a corresponding cut or section 110 through the silicon block 100. When cut all the way through to the cutting beam 102, the sections 110 define a plurality of ultra thin silicon wafers 112.

A conventional high-speed wire saw process for cutting a silicon ingot typically adheres free abrasive grains from a slurry and is operated a wire speed of 7–20 meters per second. In a preferred embodiment, a composition cutting solution comprising a high lubricity fluid characterized by high heat transfer is provided in a reservoir in a standard manner for sluicing the silicon block 100.

When slicing ultra thin wafers with a conventional wire saw, one of the problems encountered is that as the wires 106 progress downward through the block of silicon 100, the wafers 112 tend to vibrate, move, or stick together. This therefore imposes an unsatisfactory upper bound on wafer thickness. That is, a silicon ingot cut by a conventional wire saw process exhibits thickness variations on both sides of the wafer sections being cut, resulting in loss of structural integrity in the finished wafer, unless the wafers are maintained at an undesirably high thickness dimension. Such an upper bound on thickness is necessary to compensate for uneven cutting into both sides of the wafer due to vibration of the wafers induced by the high tensile strength wire. Such thickness variations typically are on the order of 25 to 50 microns.

To help prevent this from happening, an aspect of the invention provides a means for supporting or stabilizing the wafers 112 when they are partially cut into the ingot. A stabilizing strip 114 provides a means for holding or supporting the wafers 112 invariantly in place against vibration during the wire sawing process. The stabilizing strip is provided with a strong adhesive material, such as any convenient quick setting epoxy on its wafer-contacting surface. Any readily available quick setting epoxy, such as those available from PERMABOND can be employed. Also, equivalent quick setting adhesives may be used, that are formulated to eliminate dripping in vertical applications. What is important is that the adhesive provide excellent adhesion, rapid bonding, (on the order of 30 seconds or less) and shear strength.

The stabilizing strip, with its strong adhesive, holds the wafers substantially immovably in place to enable further slicing substantially without vibration. This advantageously reduces vibration induced thickness variations in the wafers. Elimination of vibration induced thickness variations advantageously enables a wafer to be sliced much thinner, on the order of 150 microns with a more consistent thickness dimension and at a much higher rate than was previously possible.

The stabilizing strip feature advantageously provides a dampening effect on vibration, thereby greatly reducing or substantially eliminating process stress within the wafers. Stabilizing the wafers against vibration during the slicing operation advantageously prevents the inducement of weak points, resulting in a structurally stronger wafer. The stabilizing strip also minimizes total thickness variations. Since the stabilizing strip stabilizes incipient wafers on both sides against vibration during the slicing process, this results in finished wafers having substantially uniform planarity, and substantially no bow or warp.

Figure 4:
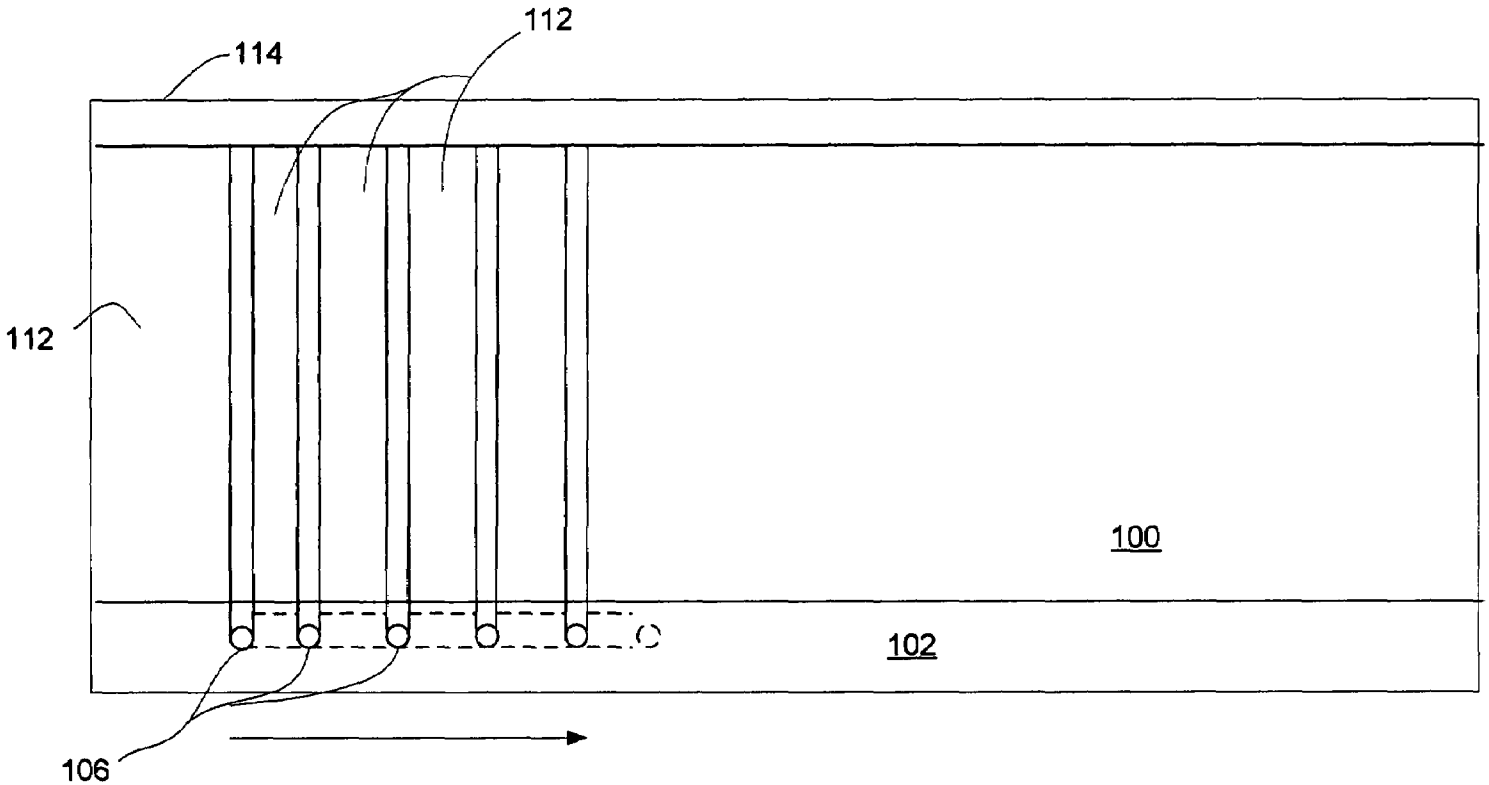
FIG. 4 is an end view of the apparatus of FIG. 1 showing how the wire is moved laterally to remove wafers from the cutting beam.

Referring to FIGS. 1 and 4, a stabilizing strip means for holding wafers in invariant alignment without vibration during the sawing process comprises a strip 114 of plastic material e.g., polypropylene characterized by a somewhat deformable durometer on the order of 95 Shore A. The stabilizing strip is provided with a strong, non viscous adhesive such as a quick setting epoxy to facilitate indentation and adherence of the exposed end surfaces or edges of the defined wafer sections to the adhesive bearing stabilizing strip when the strip is brought into contact with the exposed edges of the incipient wafer sections being cut by the wire web. The stabilizing strip is automatically affixed by contact pressure and adhesion to the exposed edge surfaces of the partially cut wafer sections after the ingot body has been cut down to a predetermined point.

The wafer stabilizing strip also may be provided with a series of slots, grooves or crenellations that are sized for contact or press fitment with a corresponding top portion of a wafer section. Each groove is sized for conformably receiving and supporting a top portion of a corresponding wafer section. The walls of the groove can extend down the edges of each respective wafer by a small amount to provide additional support for the wafer sections and further dampen vibratory effects of the cutting wires. Alternatively, the stabilizing strip can be any material having surface properties capable of supportably engaging and holding the defined wafer sections immovably against vibration, such as by pressure contact and conformable engagement or indention, with the exposed edges or end surfaces of the defined wafer sections.

The stabilizing strip also comprises a wafer handling means for transporting or processing wafers after sawing. In this mode, the stabilizing strip must be characterized by sufficient stiffness to dampen vibration and hold the wafers firmly. At the same time, the material for the stabilizing strip must have sufficient flexibility and/or extensibility to enable the wafers to be fanned into cassettes for processing or transporting.

In a wafer-handling mode, the stabilizing strip also may comprise a crenellated block of non-corroding material such as stainless steel or aluminum. Such material enables the wafers to be held immovably against vibration while providing sufficient flexibility for wafer transport. The stabilizing strip can be broken into sections to handle convenient sub groups of wafers (50–100 or more) sawn from the ingot.

A wafer handling means such as a wafer-handling interface 126 comprises a conventional end effector 128 that in response to corrective feedback signals, mechanically aligns the adhesive surface of the stabilizing strip 114 in a predetermined position on wafer sections 110 in accordance with standard wafer handling techniques. Wafer handling interfaces are well known and used extensively in the semiconductor industry to automatically and precisely position wafers to be held in a wafer carrier for a desired process operation.

In general, wafer-handling interface 126 includes an arm or end effector 128 for transporting and securing the stabilizing strip in precise alignment with the wafer sections 110. A proximity sensor 124 is coupled with wafer handling interface 126 through active feedback line 130. Proximity sensor 124 is located at any convenient point for defining an active scanning region or window that encompasses the distal edges of wafer sections 112 and corresponding lateral edge of stabilizing strip 114. Any suitable optical or electrical proximity sensor may be used that produces an output signal as a function of fine deviations in the lateral proximity or movement of the stabilizing strip 114 with respect to the lateral edge of a section 112 at a distal end of silicon block 100. The proximity sensor 124 produces corrective feedback signals over line 130 to enable wafer handling interface 126 and associated end effector 128 to precisely position adhesive surface of stabilizing strip 114 to immovably hold wafer sections 112 for subsequent slicing.

Alternatively, stabilizing strip 114 may be provided with registration guides or projections 120 for providing precise mechanical alignment of stabilizing strip 114 with respect to adjacent surfaces of distal wafer sections 110.

It will be appreciated that stabilizing strip 114 serves to keep the wafer sections 112 separate and immobilized during the remaining slicing process. It also insulates the wafers from process stress enabling the slicing of ultra thin wafers.

Referring to FIG. 4, after the wire has cut through the ingot and formed the wafer, means are provided for moving the wire web laterally to remove the wafers from the cutting beam 102. The plurality of wafers are then held firmly in the stabilizing strip. Stabilizing strip 114 also greatly facilitates handling the wafers for further processing after the slicing is completed. Stabilizing strip 114 also can be used to facilitate the cleaning of the released wafers 116 and provides accelerated and automated placing of the wafers 116 in cassettes for subsequent wafer handling operations (not shown for clarity). Note, that due to the relatively deformable character of the stabilizing strip and shear strength of the adhesive holding the wafers, the stabilizing strip advantageously can be bent to fan out the wafers to facilitate automated placement into wafer carriers or cassettes having receptacles of varying dimensions for subsequent cleaning or processing operations.

Figure 5:
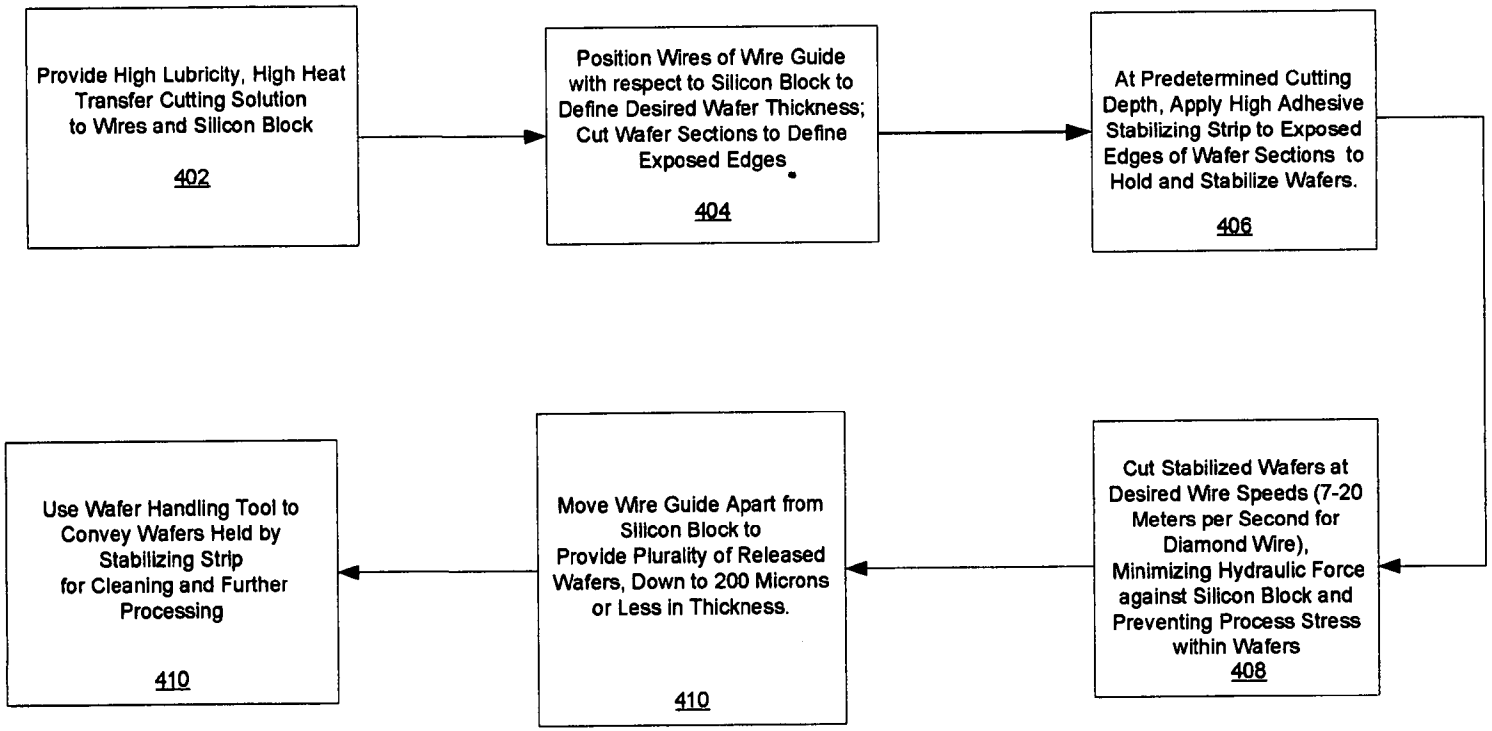
FIG. 5 is a process diagram for slicing a block of silicon into ultra thin wafers in accordance with an aspect of the invention.

FIG. 5 shows a flow diagram for implementing the foregoing features in a process for slicing a block of silicon into ultra thin wafers. A cutting solution, such as a polyethylene glycol solution is applied 402 to a conventional brass plated steel wire and a silicon block. A cutting solution, such as water and surfactant, (for example sodium hydroxide, typically 0.1% solution) is used in conjunction with diamond coated or diamond impregnated wire (see infra). The wire is positioned (404) on the wire guide 108 such that a predetermined distance between each wire defines the thickness of the released wafers. For example, if the kerf width is 150 microns and it is desired to produce wafers 150 microns thick, the wires are positioned 300 microns apart. The wires can be positioned at any convenient distance apart to define wafers down to dimensions on the order of 200 microns or less; 150 microns is shown as a non-limiting example. The silicon block is then sliced at wire speeds in a range of 5–10 meters per second. At a predetermined cutting depth (406), a high adhesive stabilizing strip is applied to the silicon block to hold and stabilize the defined wafer sections against vibration. The stabilized wafer sections are next cut through (408) to provide a plurality of wafers 150 microns or less in thickness. Since the stabilizing strip still holds the wafers at a first end, the wire web can be moved laterally such that the stabilizing strip holds the released, but stabilized wafers. The shear strength of the adhesive holding the wafers to the stabilizing strip surface and/or the shear strength of the indentations holding the wafers in the stabilizing strip enables the wire web to move laterally to release the wafers, such that the first ends of the wafers remain fixedly held in the stabilizing strip. The stabilizing strip is also characterized by an optimal overall flexural rigidity such that the strip advantageously can be bent to fan out the wafers to facilitate automated placement into wafer carriers or cassettes. A wafer-handling tool conveys (410) the stabilizing strip and wafers for cleaning and further processing.

In contrast to a conventional wire saw process, the stabilizing strip locks the sliced wafers securely against vibration and prevents contact between wafers during cutting. The stabilizing feature advantageously provides a dampening effect on process stress within the wafers. This results in a structurally stronger wafer. The stabilizing strip also enables wafers to be sliced to tighter tolerances, down to dimensions on the order of 200 microns or less, while substantially eliminating wafer deformities and irregular surfaces. This provides advantages of lower kerf loss and higher material utilization.

In accordance with another aspect of the invention, a stabilized wire saw system, comprises a stabilizing strip for holding the wafers immovably against vibration and a small diameter diamond coated or diamond impregnated wire and a high lubricity fluid composition for cutting ultra thin silicon wafers. The high lubricity characteristics of the fluid are provided by a mixture of water and a surfactant such as sodium hydroxide, typically 0.1% solution, to increase water carried through the cut on the wire. A continuous steel wire 106 bonded with a diamond surface is supported by opposing wire guides 108 (one shown for clarity) that provides a plurality of cutting surfaces for cutting through the block of silicon. Diamond-coated, diamond impregnated, or otherwise diamond bonded wire is well known and can be obtained, for example, from Laser Technology West, 1605 South Murray Blvd., Colorado Springs, Colo. 80916. Such diamond wire is characterized by a high tensile core wire, heat treated and pre-stretched, with a tensile strength in excess of 400,000 psi.

The use of diamond impregnated wire advantageously provides a fixed rate of abrasive particles thereby eliminating complex systems for varying the feed rate of slurry to compensate for variations in the rate of transport of abrasive grains, in contrast to a conventional wire saw system.

Due to the high lubricity characteristics of the fluid, the diamond-coated wire, being a fixed abrasive, can be operated at much lower wire speeds, on the order of 4–8 meters per second. The much lower wire speed and elimination of free abrasive particle agglomeration advantageously result in much lower hydraulic forces being applied to cut the wafers. The lower wire speed, in combination with the stabilizing strip for stabilizing the wafer sections against vibration (described supra, facilitates the cutting of ultra thin wafers 112, down to dimensions on the order of 100–200 microns or less. Such wafers are characterized by substantially uniform thickness and planarity and the elimination of bow and warp which is not cost effective using a conventional wire sawing process.

Since lower wire speed reduces stress, this also enables the use of smaller wires without breakage and results in further advantages such as lower kerf loss and higher material utilization.

Accordingly, the foregoing features of the invention provide a wire saw system for mass production of ultra thin wafers characterized by a minimized total thickness variation and substantially uniform planarity, without bow or warp. The mass production of such ultra thin wafers was not previously cost effective using a conventional wire saw process While the invention has been described in connection with what are presently considered to be the most practical and preferred embodiments, it is to be understood that the invention is not limited to the disclosed embodiments and alternatives as set forth above, but on the contrary is intended to cover various modifications and equivalent arrangements included within the scope of the following claims.

For example, other compositions for the cutting solution that are characterized by extremely low viscosity and high heat transfer equivalent to polyethylene glycol solutions may be used. Also, other configurations for the stabilizing strip may be used to support the wafers. What is important is that the strip must support the sides of each adjacent wafer section, as they are being cut, and hold the wafers substantially immobile and without vibration so that uniform cutting action can be obtained and thickness variations reduced, resulting in a much thinner, structurally stronger wafer with low kerf loss and greater material utilization. Therefore, persons of ordinary skill in this field are to understand that all such equivalent arrangements and modifications are to be included within the scope of the following claims

I claim:

1. A wire saw for cutting a plurality of wafers from an ingot or block of silicon comprising:

a wire web comprising a plurality of cutting surfaces spaced apart for defining corresponding wafer sections cut through the ingot;

a slurry material comprising a high lubricity fluid for lubricating the cutting surfaces; and a stabilizing means, applied to edges of wafer sections after initial cutting by the wire web defines the wafer sections, for supportably holding each wafer section substantially immovably against vibration and contact between wafers during cutting, and optionally for enabling lateral translation of the wire web for releasing wafers from the ingot, the stabilizing means comprising a plastic strip provided with a series of grooves, each groove sized for supportably holding a corresponding wafer section such that the wafer section is stabilized against vibration during cutting and held for placement into a cassette for further processing.

2. A wire saw as in claim 1, wherein the stabilizing means further comprises a plastic strip provided with a strong adhesive for contact bonding to the edges of defined wafer sections such that the wafer sections are stabilized against vibration or movement as they are being cut.

3. A wire saw as in claim 1, wherein the stabilizing means further comprises a strip provided with a surface for supporting the edges of the defined wafer sections for holding the wafers against vibration, preventing vibration induced thickness variations during cutting and holding wafers firmly during subsequent transport.

4. A wire saw as in claim 1 further comprising:

means for moving the wire web laterally to release cut wafers from the ingot or block of silicon; and transport means connected to the stabilizing means for transporting the supported wafers into cassettes for further processing.

5. A wire saw as in claim 4, wherein the stabilizing strip further comprises a wafer holding surface characterized by high adhesion and optimal flexural rigidity to facilitate fanning of the wafers into cassettes.

6. A wire saw for cutting a plurality of ultra thin wafer sections in a range of down to 200 microns or less through an ingot or block of silicon comprising:

a wire web comprising a plurality of diamond impregnated or diamond coated steel wires spaced apart for defining corresponding wafer sections to be cut through the ingot;

a high lubricity, fluid for lubricating the wires; and a stabilizing means applied to free ends of partially cut wafer sections for supportably holding the wafer sections substantially immovably against vibration, oscillation or contact between wafers as the wafer sections are cut through the ingot, and for transporting cut wafers for further processing.

7. A wire saw as in claim 6, wherein the stabilizing means further comprises a plastic strip provided with a strong adhesive for contact bonding the ends of defined wafer sections such that the wafer sections are stabilized against vibration or movement as they are further cut.

8. A wire saw as in claim 6, wherein the stabilizing means further comprises a strip provided with a surface for forming a stabilizing bond with the defined wafer sections for holding the wafers substantially immovably against vibration and contact between wafers during cutting and subsequent transport.

9. A wire saw as in claim 8, wherein the stabilizing means further comprises a strip having optimal flexural rigidity for enabling the wire web to be moved laterally to release the wafers from the ingot for subsequent processing.

10. A process for cutting wafers from an ingot or block of silicon comprising:

positioning a plurality of wires on a wire guide for defining a corresponding plurality of wafer sections to be cut through the ingot or block of silicon;

cutting the ingot or block with the wire web to a predetermined depth for exposing first edges of the wafer sections;

applying a stabilizing means to the exposed first edges for supportably holding the wafer sections substantially immovably against vibration, oscillation or contact between wafers as the wafer sections are cut through the ingot.

11. A process according to claim 10 further comprising the step of moving the wire guide to release the wafers from the ingot such that the wafers remain supportably held by the stabilizing means.

12. A process according to claim 10 further comprising the step of transporting the supportably held wafer sections for cleaning and further processing.

13. An ultra thin silicon wafer for a solar cell, cut from a block of silicon, the wafer being characterized by a thickness dimension on the order of 200 microns or less, having substantially uniform planarity, minimized total thickness variation, and enhanced structural integrity without sawing induced defects, made by the process comprising:

positioning a plurality of wires on a wire guide for defining a corresponding plurality of wafer sections to be cut through the ingot or block of silicon;

cutting the ingot or block with the wire web to a predetermined depth for exposing edges of the wafer sections;

applying a stabilizing means to the exposed edges for supportably holding the wafer sections substantially immovably against vibration, oscillation, or contact between wafers and for dampening the wafers against internal process stress as the wafer sections are cut all the way through the ingot.

14. A wire saw for cutting a plurality of wafer sections through an ingot or block of silicon from a first surface thereof through to an opposed surface comprising:

a wire web comprising a plurality of cutting surfaces spaced apart for defining corresponding wafer sections cut through the ingot;

a slurry material comprising a high lubricity fluid for lubricating the cutting surfaces; and a stabilizing strip applied to ends of partially cut wafer sections for supportably holding each wafer section substantially immovably against vibration, oscillation or contact between wafers as the wafer sections are further cut through the ingot, wherein the stabilizing strip comprises a crenellated block of non-corroding material for holding the wafer sections immovably against vibration while providing sufficient flexibility for wafer transport.

15. A wire saw for cutting a plurality of wafer sections through an ingot or block of silicon from a first surface thereof through to an opposed surface Page 5 of 6 comprising:

a wire web comprising a plurality of cutting surfaces spaced apart for defining corresponding wafer sections to be cut through the ingot;

a slurry material comprising a high lubricity fluid for lubricating the cutting surfaces; and a stabilizing strip applied to ends of the defined wafer sections for supportably holding each wafer section substantially immovably against vibration or contact between wafers during cutting, and optionally during lateral translation of the wire web for releasing the cut wafers from the ingot, wherein the stabilizing strip comprises a crenellated block of non-corroding material for holding the wafer sections immovably against vibration while providing sufficient flexibility for wafer transport, and wherein the block of non corroding material comprises stainless steel, aluminum or the like.

* * * * *